US011670149B1

(12) United States Patent
Mobley

(10) Patent No.: US 11,670,149 B1
(45) Date of Patent: Jun. 6, 2023

(54) INTRUDER DISTRACTOR DEVICE

(71) Applicant: Mountain Asset Management, LLC, Hendersonville, NC (US)

(72) Inventor: Larry Mobley, Hendersonville, NC (US)

( * ) Notice: Subject to any disclaimer, the term of this patent is extended or adjusted under 35 U.S.C. 154(b) by 32 days.

(21) Appl. No.: 17/570,215

(22) Filed: Jan. 6, 2022

(51) Int. Cl.

| | |
|---|---|
| ***F21V 19/00*** | (2006.01) |
| ***G08B 15/00*** | (2006.01) |
| ***F21V 23/04*** | (2006.01) |
| ***F21V 33/00*** | (2006.01) |

(52) U.S. Cl.
CPC ..... *G08B 15/008* (2013.01); *F21V 23/0435* (2013.01); *F21V 23/0478* (2013.01); *F21V 33/0076* (2013.01)

(58) Field of Classification Search
None
See application file for complete search history.

(56) References Cited

U.S. PATENT DOCUMENTS

2013/0099922 A1* 4/2013 Lohbihler ..... G08B 13/184 340/539.17
2016/0330825 A1* 11/2016 Recker ..... H05B 47/115
2020/0051412 A1* 2/2020 Swiss ..... G08B 13/19632

* cited by examiner

*Primary Examiner* — Elmito Breval
(74) *Attorney, Agent, or Firm* — Vladimir Postnikov

(57) ABSTRACT

An intruder distraction device comprising a trigger unit and a defense unit is disclosed. A user may be able to wirelessly active the defense unit using the trigger unit. Components of the defense unit include a distractor light, a high-intensity flashbulb, a reflector, a speaker, a power switch, a wireless signal receiver, cameras, and the like. Upon receiving the trigger signal from the wireless signal transmitter, the defense unit may be activated to sequentially perform the steps of playing a gun-cocking sound via the speaker, illuminating the distractor light for around 0.5 seconds, illuminating the high-intensity flashbulb via the reflector in a high intensity mode for around 0.5 seconds, and illuminating the high-intensity flashbulb via the reflector in a low intensity mode until the defense unit is powered off by the user.

12 Claims, 5 Drawing Sheets

INTRUDER DISTRACTOR DEVICE

TECHNICAL FIELD

The present disclosure is related to the field of security systems. More particularly, the present disclosure is related to a home security system that detects and distracts potential intruders.

BACKGROUND

Security devices such as burglar alarms are widely used across the world to raise alarm when a break-in is detected. In most cases, the alarm merely includes a siren that is switched on when a break-in is detected. Intruders are usually aware of such systems and take due care to tackle such scenarios. More particularly, armed intruders may not be intimidated by such tactics.

When an armed intruder successfully manages to break into the living room or bedroom, residents usually are intimidated and do not get a window of opportunity to escape or take counteraction. In such scenarios, the intruder has the initiative. However, if residents are provided with a solution to intimidate and incapacitate the intruder for a short time window, they may be able to gain the initiative themselves. Residents may use this initiative to take effective countermeasures including escaping from the room/house or counterattacking the intruder.

U.S. Pat. No. 5,685,636A discloses a fixed or portable non-lethal laser security device and method for use of such device as a non-damaging weapon and security system to provide warning and visual impairment upon an intruder. At a predetermined laser wavelength and intensity, this invention utilizes laser light in the visible portion of the wavelength spectrum to create temporary visual impairment, hesitation, delay, distraction, and reductions in combat and functional effectiveness through the effects of glare, flash blind, and psychological impact. The preferred embodiment of the laser security device in the present invention involves the use of laser technology with a remotely operated security system. The device should have a housing structure to protect the internal components from damage or destruction, the ability to produce and transmit visible laser light over various wavelengths and intensities, a power source to drive the laser light, a collimating lens to focus the laser light, and should also be capable of coupling and communicating with an existing security device such as a remote-control closed-circuit television camera mounted upon a pan and tilt head. Upon detection of an intruder, the laser security device is capable of visually warning the intruder of the detection. If the intruder further intrudes, the laser security device impairs the intruder's visual capabilities by the effects of flash blind and glare, allowing security forces time to respond to the intrusion and intercept the intruder.

U.S. Pat. No. 9,922,516B2 discloses a method and system that enables a first responder police Incident Commander to take command and control of a building having an active suspect ongoing event. Using the method and system herein, the Police Incident Commander is able to clearly distinguish the positions of his building entry teams (BETs) in the building relative to the position of the suspect through a graphic display of Friend and Foe designation whereupon he can precisely direct their maneuver to close with the suspect. The incident commander communicates to a Command and Control Center to arm non-lethal chemical canisters pre-located in "Hot Zones" for use in remotely incapacitating the intruders. When the intruders, boxed in by the BETs, enter a "Hot Zone" the incident commander gives the command to release the non-lethal chemical/smoke, ammonia spray that disorients and blinds the intruders allowing the BETs to safely end the incident.

U.S. Pat. No. 8,721,105B2 discloses an optical device for incapacitating individuals exposed to generated light. It has a housing with a head portion and window opening, a reflector with a focus facing the window opening, a power source, an electric lamp mounted at the reflector's focus. It emits a high-intensity incoherent light beam of between 380-780 nm. It has a switching and isolation circuit connected to a pulse mode power conversion and a first control circuit to the electric lamp, and connected in parallel to a steady-state mode power conversion and a second control circuit to the electric lamp. Both the pulse mode power conversion and control circuits are connected in common to the power source. The circuits apply pulses of power to the electric lamp temporarily increasing the total luminous flux to incapacitate one or more targeted individuals within a duration of fewer than 2 seconds.

U.S. Pat. No. 7,040,780B2 discloses a non-lethal laser weapon having a base to which a number of lasers are mounted. The lasers include a first laser oriented to project a first laser beam in a first direction, and a second laser oriented to project a second laser beam generally in the first direction. The first laser beam and the second laser beam overlap at a first distance from the base, to thereby form separate first and second first-order illumination zones before the first distance, and a first second-order illumination zone beyond the first distance. Additional lasers may be included in one-, two-, and three-dimensional patterns to create additional illumination zones.

While the prior-arts disclose different techniques for detecting and preventing intruders, they may not psychologically intimidate the intruder thereby providing the residents with the power or opportunity to act or take charge before the intruder does. In many cases, a few minutes of physiological and psychological initiative may be enough for the residents to gain the upper hand over the intruder. There is thus a need for an improved security device that not only prevents intruders but also intimidates and incapacitates them for the purposes of providing residents physiological and psychological initiative.

SUMMARY OF THE INVENTION

In light of the disadvantages mentioned in the previous section, the following summary is provided to facilitate an understanding of some of the innovative features unique to the present invention and is not intended to be a full description. A full appreciation of the various aspects of the invention can be gained by taking the entire specification and drawings as a whole.

Embodiments of the present disclosure propose an intruder distraction device comprising a defense unit and a trigger unit. The two units communicate to each other wirelessly. A user may be able to activate the defense unit using the trigger unit. The trigger unit basically comprises a wireless signal transmitter that transmits a trigger signal to activate the defense unit. A user/resident may press a button provided on the trigger unit to send a trigger signal which in turn activates the defense unit. Components of the defense unit include a distractor light, a high-intensity flashbulb, a reflector, a speaker, a power switch, a wireless signal receiver, cameras, proximity sensors, and the like. The wireless signal transmitter of the trigger unit can send a trigger signal to the wireless signal receiver of the defense unit. Upon receiving the trigger signal from the wireless signal transmitter, the defense unit is activated to sequentially perform the steps of: (i) playing a gun-cocking sound via the speaker, (ii) illuminating the distractor light for 0.5 seconds, (iii) illuminating the high-intensity flashbulb via the reflector in a high-intensity mode for 0.5 seconds, and (iv) illuminating the high-intensity flashbulb via the reflector in a low-intensity mode until the defense unit is powered off by the user.

This summary is provided merely for purposes of summarizing some example embodiments, in order to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following detailed description and figures.

The abovementioned embodiments and further variations of the proposed invention are discussed further in the detailed description.

Figure 1:
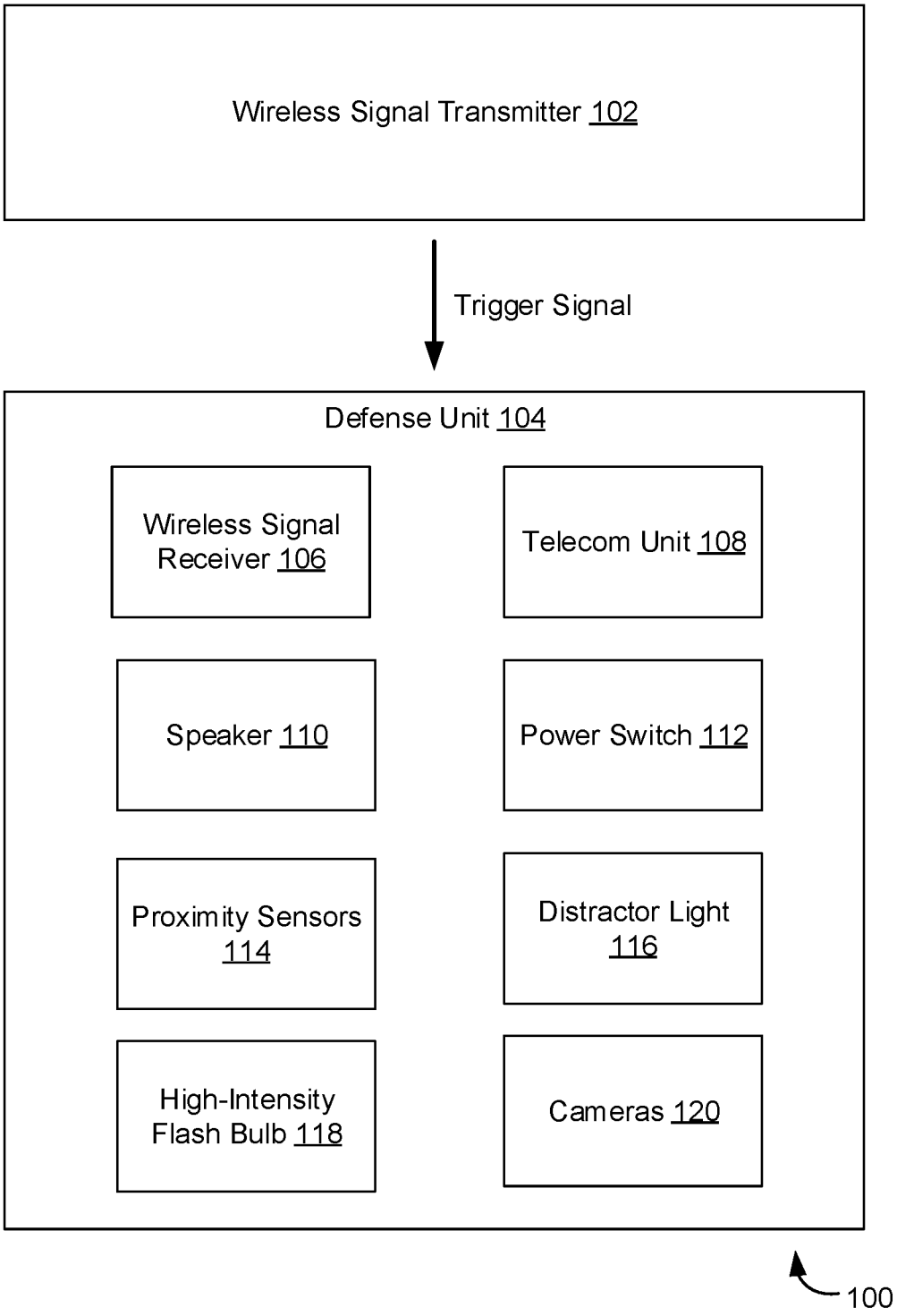
FIG. 1 is a block diagram of the main components of the intruder distractor device according to the embodiments of the present disclosure.

The drawings described herein are for illustration purposes only and are not intended to limit the scope of the present subject matter in any way.

DETAILED DESCRIPTION OF THE INVENTION

In the following description of the embodiments of the invention, reference is made to the accompanying drawings that form a part hereof, and in which are shown by way of illustration specific embodiments in which the invention may be practiced. These embodiments are described in sufficient detail to enable those skilled in the art to practice the invention, and it is to be understood that other embodiments may be utilized and that changes may be made without departing from the scope of the present invention. The following detailed description is, therefore, not to be taken in a limited sense, and the scope of the present invention is defined only by the appended claims.

The specification may refer to "an", "one" or "some" embodiment(s) in several locations. This does not necessarily imply that each such reference is to the same embodiment(s), or that the feature only applies to a single embodiment. A single feature of different embodiments may also be combined to provide other embodiments.

As used herein, the singular forms "a", "an", and "the" are intended to include the plural forms as well, unless expressly stated otherwise. It will be further understood that the terms "includes", "comprises", "including" and/or "comprising" when used in this specification, specify the presence of stated features, integers, steps, operations, elements and/or components, but do not preclude the presence or addition of one or more other features integers, steps, operations, elements, components, and/or groups thereof. As used herein, the term "and/or" includes any and all combinations and arrangements of one or more of the associated listed items.

Unless otherwise defined, all terms (including technical and scientific terms) used herein have the same meaning as commonly understood by one of ordinary skill in the art to which this disclosure pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The intruder distractor device may be referred to as a "distraction device", "security device" interchangeably according to the context of the sentence. The term "intruder," "bad actor," and "burglar" may be used interchangeably according to the context of the sentence. The terms "user" and "resident" may be used interchangeably. The terms used herein do not restrict the scope of the apparatus to one or two instruments.

According to the embodiments of the present disclosure, a security device for distracting intruders is disclosed. The security device may be placed inside homes at strategic locations that are usually prone to break-ins such as directly in front of doors of living rooms, bedrooms, and the like. The security device primarily comprises two primary units: the defense unit and the trigger unit. The trigger unit includes a wireless signal transmitter that is capable of transmitting trigger signals upon being activated by the user. In some embodiments, the trigger unit may comprise of a simple button mechanism that, when pressed, sends trigger signals to the wireless signal receiver present in the defense unit.

The two units communicate to each other wirelessly. A user may be able to activate the defense unit using the trigger unit. The trigger unit essentially comprises a wireless signal transmitter that transmits a trigger signal to activate the defense unit. A user/resident may press a button provided on the trigger unit to send a trigger signal which in turn activates the defense unit. The trigger unit may be disposed of at strategic locations including bed headboards, mattresses, pillows, and the like. The trigger unit may be readily accessible to the user during emergency situations.

Components of the defense unit include a distractor light, a high-intensity flashbulb, a reflector, a speaker, a power switch, a wireless signal receiver, cameras, proximity sensors, and the like. The audio generated by the speaker (preferably the loading sound of a shotgun) may alert the intruder of a possible defensive gun in their proximity. This intimidates the intruder and may distract the attention of the intruder towards the defense unit. This is followed by illumination of the distractor light. The distractor light may have a lesser intensity than that of the high-intensity flashbulb. The primary goal of the distractor light is to direct the attention of the intruder towards the defense unit. The high-intensity flashbulb, on the other hand, is capable of operating at different intensities. The high-intensity flashbulb illuminates at the highest intensity immediately after the distractor light turns off so that the light beam temporarily blinds the intruder. The high-intensity flashbulb is backed by a reflector which makes sure that the area of impact of the light is sufficiently broad enough to temporarily blind the intruder. The reflector further increases the intensity of the light generated by the high-intensity flashbulb.

The wireless signal transmitter of the trigger unit can send a trigger signal to the wireless signal receiver of the defense unit. Upon receiving the trigger signal from the wireless signal transmitter, the defense unit is activated. Upon activation, the defense unit is configured to sequentially perform a series of steps that may incapacitate, intimidate, and/or confuse the intruder temporarily. Firstly, audio is played via the speaker of the defense unit. One or more intimidating sounds may be played via the speaker including a "snick—snick" ratchet sound of a 12-gauge shotgun being loaded or other related sounds. Other sounds may also be played via the speaker as understood by a person skilled in the art. Secondly, the distractor light may be illuminated to direct the attention of the intruder towards the defense unit. The distractor light may be configured to illuminate in any user-configured color. The distractor light may be illuminated for around 0.5 seconds before proceeding to the next step. In the third step, it is assumed that the intruder's attention is directed towards the defense unit after hearing the gun loading audio and then seeing the illumination of the distractor light. Subsequently, the high-intensity flashbulb is illuminated at a high-intensity mode such that the light beam hits the vision of the intruder for around 0.5 seconds. Lastly, the high-intensity flashbulb is illuminated at a low-intensity mode until the defense unit is powered off by the user. It may be noted that the lights may be illuminated for different time periods other than 0.5 seconds as understood by a person skilled in the art. The example given herein does not limit the scope of the present invention.

The defense unit may be placed away from the user's bed, on a dresser, on a table, or on a mantle, roughly pointing the reflector towards the bedroom door and away from the user's bed. The defense unit may be powered ON for the night. When powered ON, the distracter light may give a confirming blink. During the night, if the user finds an intruder in the room, he/she may activate the trigger. As the user is aware of the sounds and lights which emanate from the activated defense unit, he/she may proactively protect himself/herself from the high-intensity light. The user may use the time during which the intruder is incapacitated to escape or take countermeasures. The high-intensity flashbulb may still work in low-intensity mode thereby providing enough light for the user to take action. If the user is mistaken, and there is no intruder, no one is harmed and the user may simply turn off the defense unit.

The defense unit may further comprise proximity sensors capable of detecting intruders. The defense unit may be configured to activate automatically upon the proximity sensor detecting an intruder. Furthermore, the defense unit may be equipped with cameras for capturing images of the intruder. The light generated by the distractor light and the high-intensity flashbulb may be used by the camera for capturing images in typically low visibility nighttime conditions. Furthermore, the security device may be paired to a telecommunication unit to initiate an emergency call to an emergency contact when the defense unit is activated. The telecommunication unit may call an emergency number such as 911 or any other emergency contact as configured by the user. Moreover, the telecommunication unit may send the captured images of the intruder to one or more emergency contacts. The telecommunication unit may further send the location of the security device to the emergency contact.

Referring to the figures, FIG. 1 is a block diagram 100 of the main components of the intruder distractor device according to the embodiments of the present disclosure. The two primary components include the wireless signal transmitter 102 (part of the trigger unit) and the defense unit 104. The wireless signal transmitter 102 sends trigger signals to the defense unit 104 to activate the defense unit 104. The defense unit comprises a wireless signal receiver 106 that receives trigger signals and activates the defense unit 104. A telecom unit 108 allows the security device to call emergency contacts (such as 911) upon detecting an intruder. The speaker 110 generates audio as described in this disclosure. The power switch 112 may be used by the user to activate/deactivate the defense unit 104. The proximity sensors 114 may be used to automatically detect intruders. The distractor light 116 may be used to direct the attention of the intruder towards the defense unit 104. The high-intensity flashbulb 118 may be used to blind the intruder by generating a strong beam of light. The cameras 120 may be used to capture the images of the intruder. The captured images may be sent to emergency contacts by the telecom unit 108.

The components of the trigger unit and defense unit, including, but not limited to, the wireless signal transmitter 102, wireless signal receiver 106, telecom unit 108, speaker 110, proximity sensors 114, distractor light 116, high-intensity flashbulb 118, and cameras 120, may be powered by a plurality of energy sources including, but not limited to, an internal rechargeable battery, external batteries which may be inserted into a structure suitable for housing and utilizing at least one battery as an energy source, and alternating current from an electric outlet.

Figure 2:
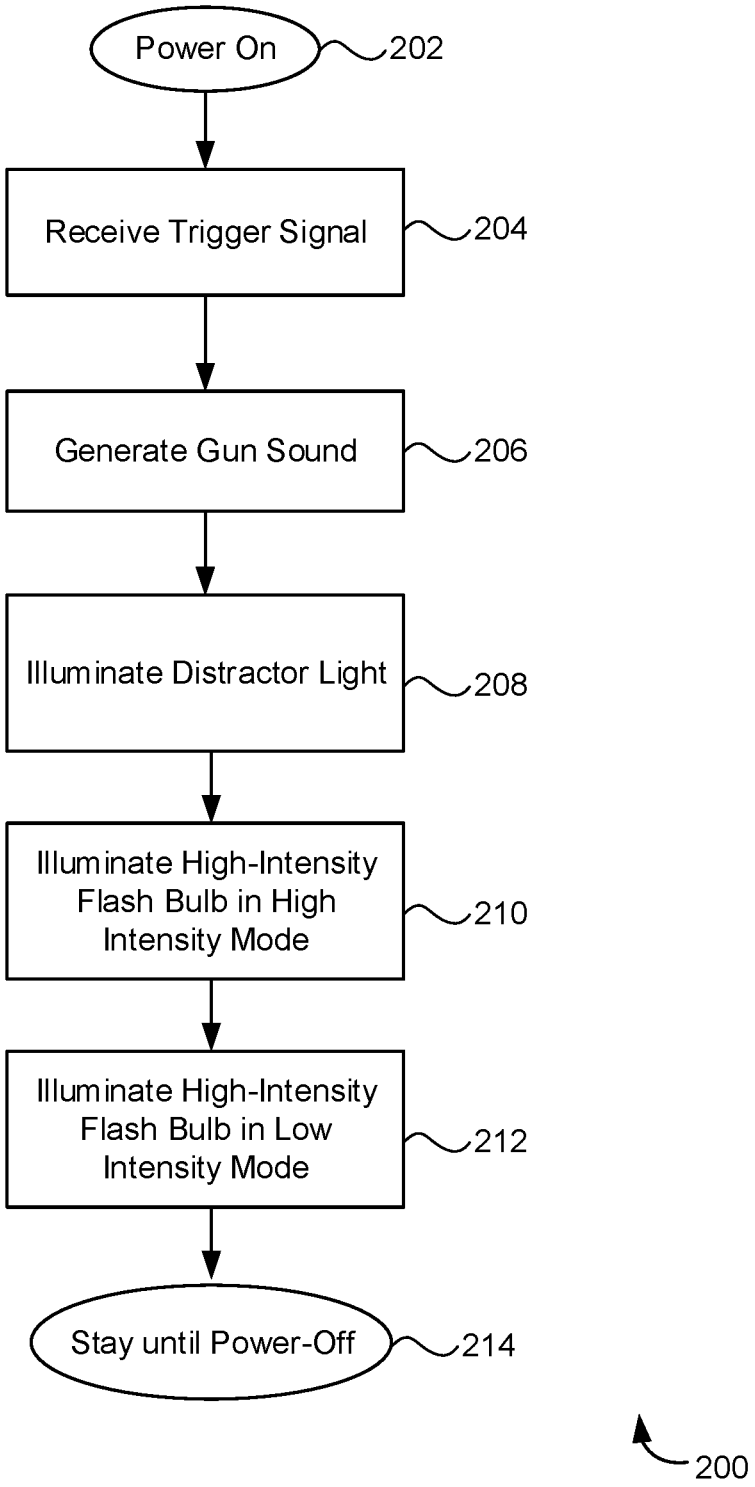
FIG. 2 is an exemplary flow diagram illustrating the primary functions of the intruder distractor device according to the embodiments of the present disclosure.

FIG. 2 is an exemplary flow diagram 200 illustrating the primary functions of the intruder distractor device according to the embodiments of the present disclosure. The defense unit is powered on at step 202 to keep the security device on standby. At step 204, a trigger signal is received by the defense unit. At step 206, a gun-cocking sound is generated by the speaker of the defense unit. At step 208, the distractor light is illuminated for about 0.5 seconds. At step 210, the high-intensity flashbulb is illuminated at high-intensity mode for about 0.5 seconds. At step 212, the high-intensity flashbulb is illuminated at low-intensity mode. At step 214, the defense unit may be turned off by the user.

Figure 3:
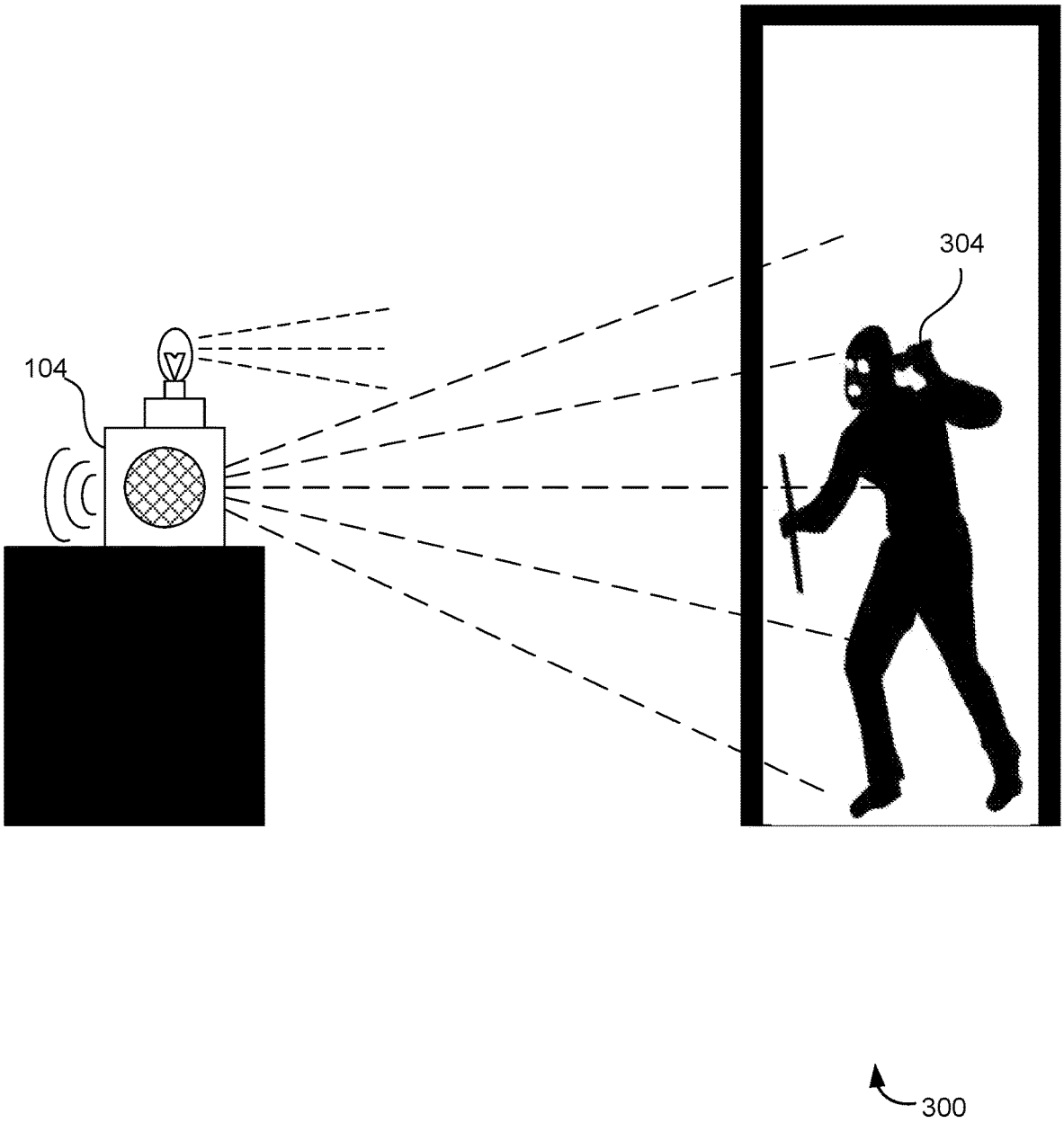
FIG. 3 is an exemplary illustration of an intruder being distracted by the intruder distractor device according to the embodiments of the present disclosure.

FIG. 3 is an exemplary illustration 300 of an intruder being distracted by the intruder distractor device according to the embodiments of the present disclosure. A burglar 304 may enter a room via an entrance door as depicted in the illustration. The defense unit 104 may be placed on a mantle facing the door. Upon receiving the trigger signal, the defense unit is activated. As illustrated, a combination of sounds and lights is generated to incapacitate the intruder for a short period, which may be used by the user to escape or take counteraction.

Figure 4:
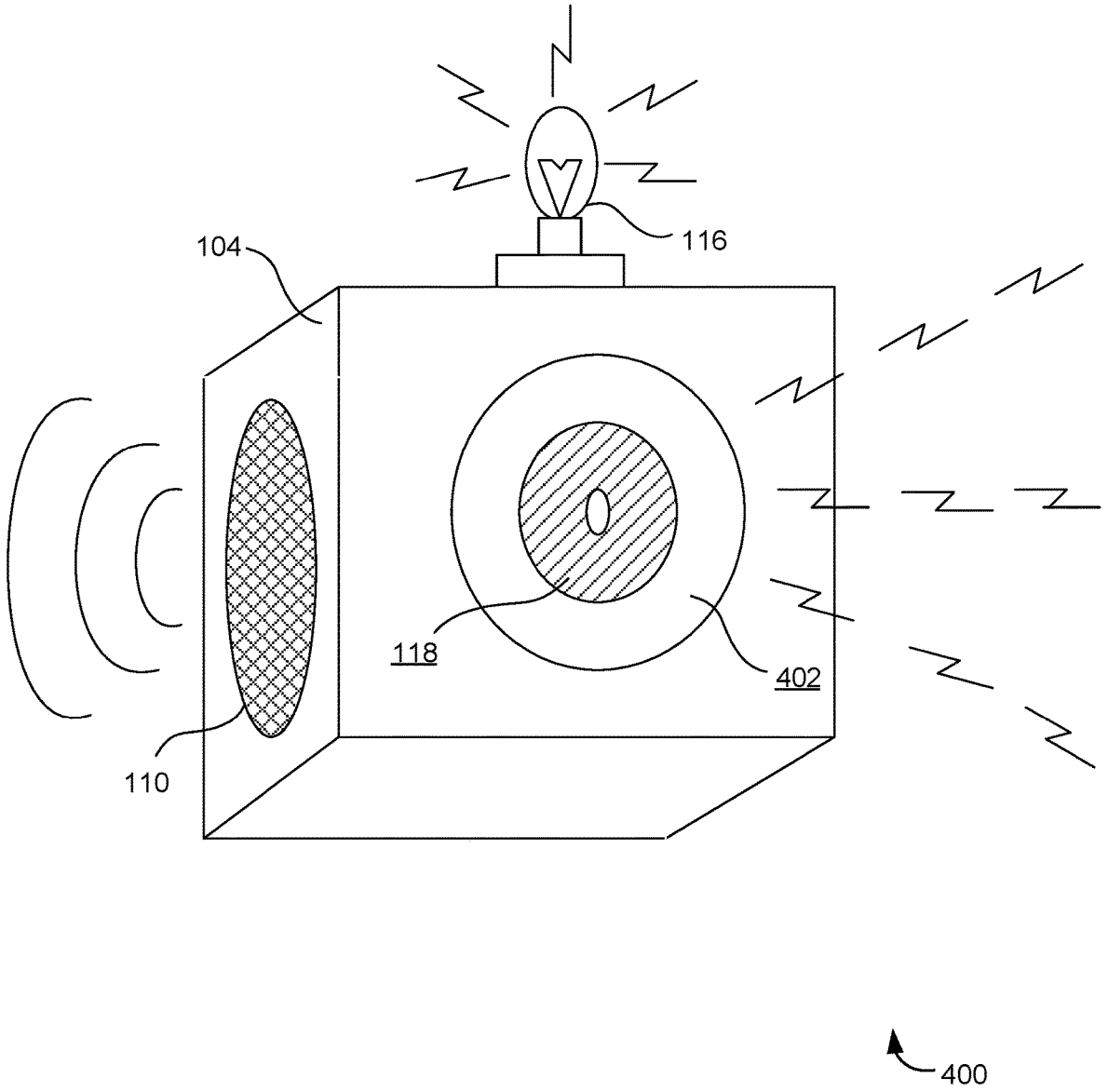
FIG. 4 is an exemplary illustration of the components of the defense unit of the intruder distractor device according to the embodiments of the present disclosure.

FIG. 4 is an exemplary illustration 400 of the components of the defense unit 104 of the intruder distractor device according to the embodiments of the present disclosure. The defense unit 104 includes a distractor light 116, a high-intensity flashbulb 118, a reflector 402, and a speaker 110. Furthermore, a power switch may be provided (not shown in the figure). It may be noted that the illustration provided here is merely exemplary and does not limit the design and/or scope of the security device.

Figure 5:
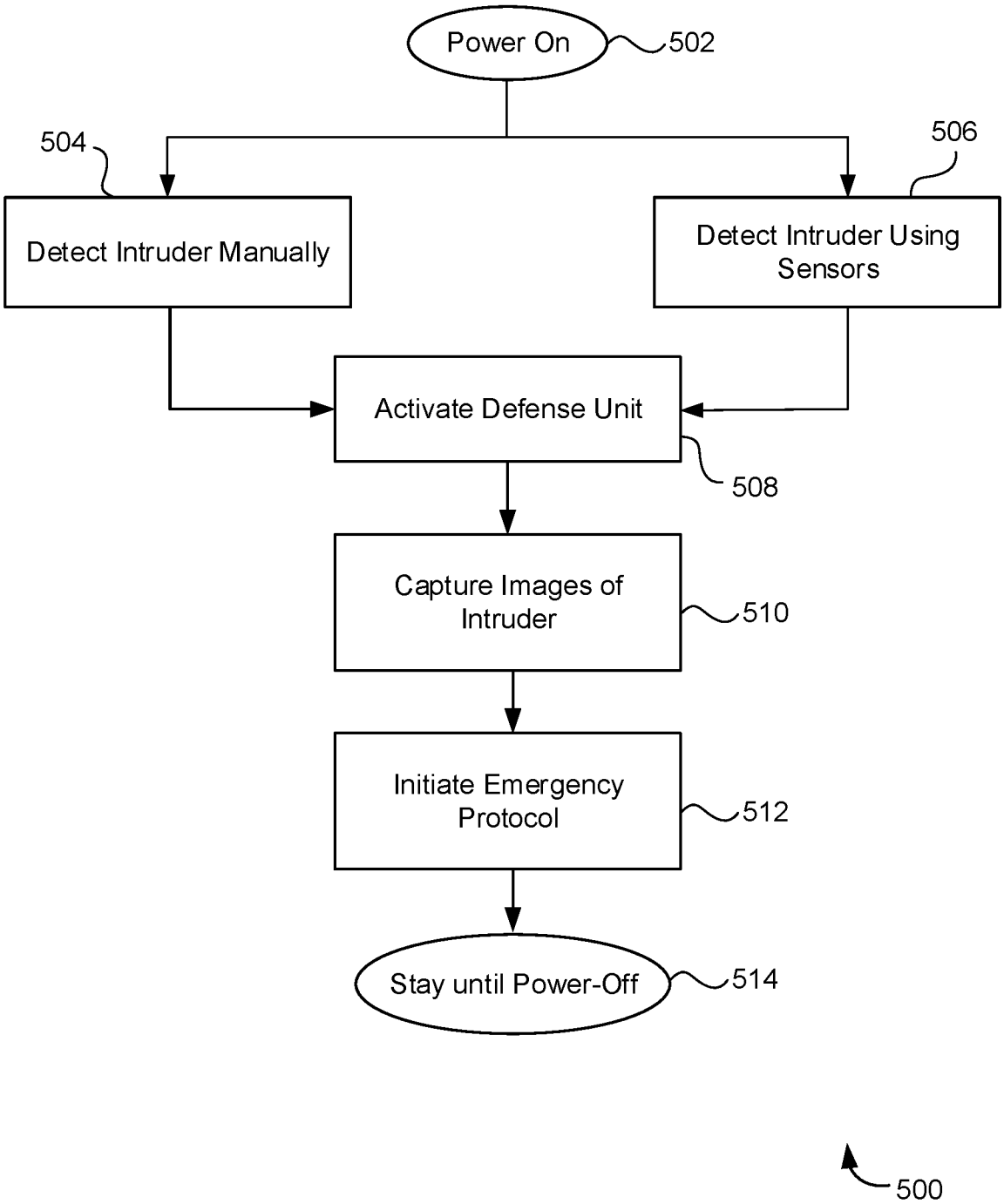
FIG. 5 is an exemplary flow diagram of the advanced functions of the intruder distractor device according to the embodiments of the present disclosure.

FIG. 5 is an exemplary flow diagram 500 of the advanced functions of the intruder distractor device according to the embodiments of the present disclosure. Herein, the security device provides secondary features including automatic detection of intruders, image capture using a camera, and initiation of emergency protocol. The device is powered on at step 502. At step 504, the intruder is detected manually by the user. The user may manually send trigger signals using the trigger unit. Alternatively, at step 506, the proximity sensors and/or the camera sensors are used to automatically detect intruders. Upon detecting the intruder manually or automatically, the defense unit is activated at step 508. Images of the intruder may be captured by the internal camera at step 510. After activation, as an additional step, an emergency protocol is initiated at step 512. The emergency protocol includes the step of calling the emergency contacts using the telecom unit and sending the location of the device, captured images, and the like. At step 514, the device is powered off.

It may be noted that the above-described examples of the present solution are for the purpose of illustration only. Although the solution has been described in conjunction with a specific embodiment thereof, numerous modifications may be possible without materially departing from the teachings and advantages of the subject matter described herein. Other substitutions, modifications, and changes may be made without departing from the spirit of the present solution. All the features disclosed in this specification (including any accompanying claims, abstract, and drawings), and/or all of the steps of any method or process so disclosed, may be combined in any combination, except combinations where at least some of such features and/or steps are mutually exclusive.

The terms "include," "have," and variations thereof, as used herein, have the same meaning as the term "comprise" or an appropriate variation thereof. Furthermore, the term "based on", as used herein, means "based at least in part on." Thus, a feature that is described as based on some stimulus can be based on the stimulus or a combination of stimuli including the stimulus.

The present description has been shown and described with reference to the foregoing examples. It is understood, however, that other forms, details, and examples can be made without departing from the spirit and scope of the present subject matter that is defined in the following claims.

What is claimed is:

1. An intruder distraction device, comprising:

a defense unit comprising a distractor light, a high-intensity flashbulb, a reflector, a speaker, a power switch, a source of energy, and a wireless signal receiver; and a wireless signal transmitter capable of sending a trigger signal to the wireless signal receiver of the defense unit, wherein upon receiving the trigger signal from the wireless signal transmitter, the defense unit is activated to sequentially perform the steps of:

playing a gun-cocking sound via the speaker;

illuminating the distractor light for 0.5 seconds;

illuminating the high-intensity flashbulb via the reflector in a high-intensity mode for 0.5 seconds; and illuminating the high-intensity flashbulb via the reflector in a low-intensity mode.

2. The intruder distraction device of claim 1, wherein the defense unit faces an entrance door of a room.

3. The intruder distraction device of claim 2, wherein the distraction light and the high-intensity flashbulb projects light towards the entrance of the room.

4. The intruder distraction device of claim 1, wherein the wireless signal transmitter is attached to a headboard of a bed, a mattress sheet, or a pillow.

5. The intruder distraction device of claim 4, wherein the wireless signal transmitter is activated by a user to transmit the trigger signal to the wireless signal receiver.

6. The intruder distraction device of claim 1, wherein the power switch of the defense unit is used to turn on/off the defense unit.

7. The intruder distraction device of claim 1, wherein the defense unit further comprises one or more proximity sensors and one or more cameras.

8. The intruder distraction device of claim 7, wherein the defense unit is automatically activated when the proximity sensors detect an intruder.

9. The intruder distraction device of claim 8, wherein the cameras capture images of the intruder when the distraction light and the high-intensity flashbulbs are illuminated.

10. The intruder distraction device of claim 9, wherein the defense unit is paired to a telecommunication unit to initiate an emergency call to an emergency contact when the defense unit is activated.

11. The intruder distraction device of claim 10, wherein the telecommunication unit sends the captured images of the intruder to the emergency contact.

12. The intruder distraction device of claim 10, wherein the telecommunication unit sends the location of the intruder distraction device to the emergency contact.

* * * * *